US011849813B1

(12) United States Patent
Wu

(10) Patent No.: US 11,849,813 B1
(45) Date of Patent: Dec. 26, 2023

(54) SHOELACE

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Changhua County (TW)

( * ) Notice: Subject to any disclaimer, the term of this patent is extended or adjusted under 35 U.S.C. 154(b) by 0 days.

(21) Appl. No.: 17/968,202

(22) Filed: Oct. 18, 2022

(51) Int. Cl.
*A43C 9/00* (2006.01)

(52) U.S. Cl.
CPC ..... *A43C 9/00* (2013.01); *Y10T 24/37* (2015.01)

(58) Field of Classification Search
CPC .... D04C 1/06; D04C 1/00; D04C 1/12; Y10T 24/37; Y10T 24/3787; A43C 1/02; A43C 9/00
See application file for complete search history.

(56) References Cited

U.S. PATENT DOCUMENTS 1,006,014 A * 10/1911 Sondley ..... D04C 1/00 87/2
2,344,963 A * 3/1944 Benowitz ..... A43C 9/00 24/712
2,477,151 A * 7/1949 Stapleton ..... A43C 9/00 24/713
6,796,008 B1 * 9/2004 Huang ..... A43C 9/00 24/712.1
10,568,389 B1 * 2/2020 Lin ..... A43C 9/00
11,753,755 B2 * 9/2023 Lu ..... D04C 3/40 87/9
11,771,178 B1 * 10/2023 Wu ..... A43C 9/00 24/715.3
2004/0216799 A1 * 11/2004 Tseng ..... A43C 9/00 139/421
2012/0144631 A1 * 6/2012 Stanev ..... D04C 1/12 24/712
2013/0255045 A1 * 10/2013 Gonzalez ..... A43C 9/00 24/715.3
2015/0359297 A1 * 12/2015 Cheng ..... D04C 1/06 87/5
2017/0340066 A1 * 11/2017 Ooki ..... D04C 1/06

* cited by examiner

*Primary Examiner* — Robert Sandy
*Assistant Examiner* — Michael S Lee
(74) *Attorney, Agent, or Firm* — Muncy, Geissler, Olds & Lowe, P.C.

(57) ABSTRACT

A shoelace is provided, including: a main body and two head portions. The main body includes a woven layer, and the woven layer includes a plurality of first strands woven with one another to form a hollow portion and a plurality of meshes communicated with the hollow portion. At least two of the plurality of meshes are open toward different directions. The two head portions are disposed on two ends of the main body and fix the plurality of first strands, and one of the two head portions is penetrable through the hollow portion and a part of the plurality of meshes.

9 Claims, 3 Drawing Sheets

SHOELACE

BACKGROUND OF THE INVENTION

Field of the Invention

The present invention relates to a shoelace.

Description of the Prior Art

Generally, a tightness of a shoelace of a shoe is adjustable, and two ends of the shoelace are tied with each other after adjustment, which allows the shoe to be fit with a user's foot. However, a conventional shoelace is easy to loosen, which may cause danger to the user if the shoelace is accidentally stepped on. Moreover, the conventional shoelace is inconvenient for children to tie, and appearance changes of the conventional shoelace are limited.

The present invention is, therefore, arisen to obviate or at least mitigate the above-mentioned disadvantages.

SUMMARY OF THE INVENTION

The main object of the present invention is to provide a shoelace, which is easy to operate and is not easy to loosen.

To achieve the above and other objects, the present invention provides a shoelace, including: a main body and two head portions. The main body includes a woven layer, and the woven layer includes a plurality of first strands woven with one another to form a hollow portion and a plurality of meshes communicated with the hollow portion. At least two of the plurality of meshes are open toward different directions. The two head portions are disposed on two ends of the main body and fix the plurality of first strands, and one of the two head portions is penetrable through the hollow portion and a part of the plurality of meshes.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
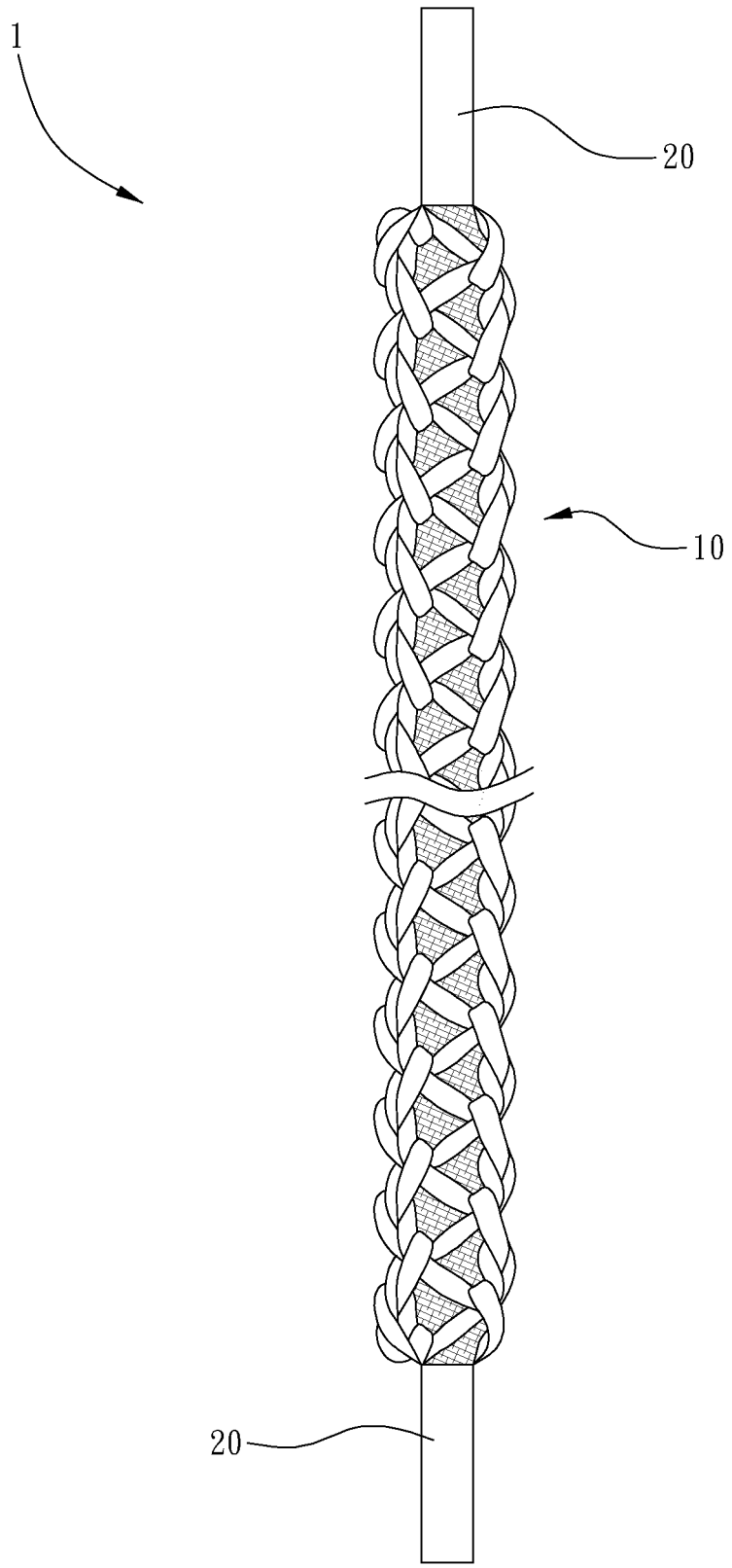
FIG. 1 is a stereogram of a preferable embodiment of the present invention.
Figure 2:
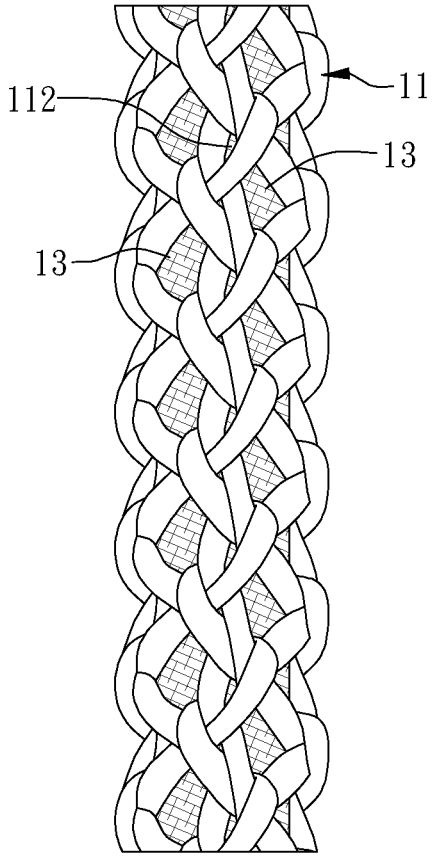
FIG. 2 is a side view of a preferable embodiment of the present invention.
Figure 3:
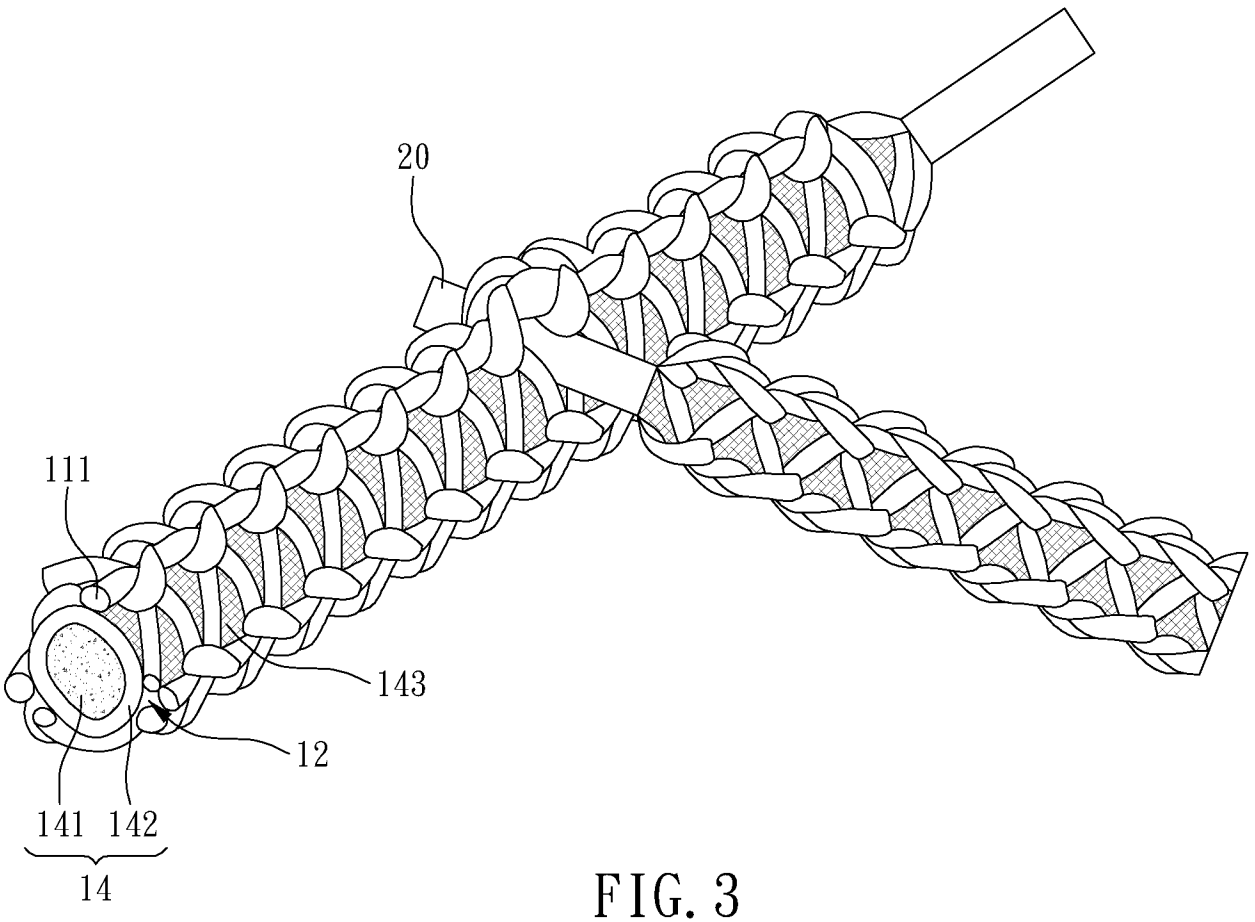
FIG. 3 is a schematic diagram according to a preferable embodiment of the present invention in use.

Please refer to FIGS. 1 to 3 for a preferable embodiment of the present invention. A shoelace 1 of the present invention includes a main body 10 and two head portions 20.

The main body 10 includes a woven layer 11, and the woven layer 11 includes a plurality of first strands 111. The plurality of first strands 111 are woven with one another to form a hollow portion 12 and a plurality of meshes 13 communicated with the hollow portion 12, and at least two of the plurality of meshes 13 are open toward different directions. The two head portions 20 are disposed on two ends of the main body 10 and fix the plurality of first strands 111, and one of the two head portions 20 is penetrable through the hollow portion 12 and a part of the plurality of meshes 13. Therefore, the two head portions 20 are penetrable through the plurality of meshes 13 as required, and the shoelace 1 can be fixed without tying, which is easy to operate and not easy to loosen.

Please refer to FIG. 3, an aperture of each of the plurality of meshes 13 is larger than or equal to a radial dimension one of the two head portions 20 for easy operation. The plurality of first strands 111 form a plurality of loops 112 sleeved to one another, and a height of each of the plurality of loops 112 is smaller than the aperture of each of the plurality of meshes 13 and is smaller than a radial dimension of each of the two head portions 20, which avoids penetrating in wrong places. The plurality of loops 112 sleeved to one another provides good structural strength of the woven layer 11. Preferably, at least two of the plurality of meshes 13 are located on a cross section of the main body 10 and dislocated from one another in a radial direction of the main body 10, as shown in FIG. 2. Therefore, the two head portions 20 are penetrable through the plurality of meshes 13 in several directions and not limited to straight penetration for stable restriction. A radial dimension of the hollow portion 12 is larger than the aperture of each of the plurality of meshes 13 so that the excess of the shoelace 1 can be received in the hollow portion 12 without overstretching the main body 10 radially, and the plurality of meshes 13 effectively restrict a portion of the main body 10 penetrating therethrough.

the woven layer 11 is stretchable in an axial direction of the main body 10, and a ratio range of length variations of the woven layer 11 before and after stretch to an unstretched length of the woven layer 11 is between 0.1 and 0.8 (preferably between 0.1 and 0.5) so that the woven layer 11 provides appropriate deformation. When the excess of the shoelace 1 is disposed through the woven layer 11, the woven layer 11 are stretched to allow the excess of the shoelace 1 to penetrate therethrough, and the woven layer 11 may be compressed to provides frictional resistance to the excess of the shoelace 1 for stable restriction. Each of the two head portions 20 may include a fixing member made of plastic or metal materials or may be an end segment of the main body 10 which is thermo-compressed and has a relative high hardness.

In this embodiment, the main body 10 further includes a core material 14 disposed through the hollow portion 12, and the core material 14 is partially exposed outwardly from the plurality of meshes 13 so as to have good structural strength and special visual effect. The core material 14 includes an inner core 141 and a cover layer 142 surrounding the inner core 141. A linear density of the inner core 141 is smaller than a linear density of the cover layer 142. When one of the two head portions 20 is disposed between the core material 14 and the woven layer 11, the core material 14 is compressed, which avoids overstretching of the woven layer 11 and provides preferable appearance. Moreover, the cover layer 142 is woven by a plurality of second strands 143, and a weave density of the cover layer 142 is larger than a weave density of the woven layer 11. Therefore, the cover layer 142 has a smooth outer surface, which prevents the two head portions 20 from being inserted into the core material 14 and allows smooth movement of the two head portions 20. At least one of the plurality of first strands 111 and at least one of the plurality of second strands 143 are different in color so as to provide diverse visual effects. Preferably, the woven layer 11 are the core material 14 are free of interference with each other and movable relative to each other in the axial direction and the radial direction of the main body 10 so that the two head portions 20 and a portion of the shoelace 1 can smoothly penetrate therebetween. In other embodiments, the main body may be configured without the core material; the core material may be a single wire.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shoelace, including:

a main body, including a woven layer, the woven layer including a plurality of first strands woven with one another to form a hollow portion and a plurality of meshes communicated with the hollow portion, at least two of the plurality of meshes being open toward different directions; and two head portions, disposed on two ends of the main body and fixing the plurality of first strands, one of the two head portions being penetrable through the hollow portion and a part of the plurality of meshes;

wherein the main body further includes a core material disposed through the hollow portion, and the core material is partially exposed outwardly from the plurality of meshes.

2. The shoelace of claim 1, wherein an aperture of each of the plurality of meshes is larger than or equal to a radial dimension one of the two head portions.

3. The shoelace of claim 1, wherein at least two of the plurality of meshes are located on a cross section of the main body and dislocated from one another in a radial direction of the main body.

4. The shoelace of claim 1, wherein the plurality of first strands form a plurality of loops sleeved to one another, and a height of each of the plurality of loops is smaller than an aperture of each of the plurality of meshes.

5. The shoelace of claim 1, wherein the woven layer is stretchable in an axial direction of the main body, and a ratio range of length variations of the woven layer before and after stretch to an unstretched length of the woven layer is between 0.1 and 0.8.

6. The shoelace of claim 1, wherein the core material includes an inner core and a cover layer surrounding the inner core, and a linear density of the inner core is smaller than a linear density of the cover layer.

7. The shoelace of claim 6, wherein the cover layer is woven by a plurality of second strands, and a weave density of the cover layer is larger than a weave density of the woven layer.

8. The shoelace of claim 1, wherein the woven layer and the core material are free of interference with each other and movable relative to each other in an axial direction and a radial direction of the main body.

9. The shoelace of claim 7, wherein an aperture of each of the plurality of meshes is larger than or equal to a radial dimension one of the two head portions; at least two of the plurality of meshes are located on a cross section of the main body and dislocated from one another in a radial direction of the main body; the plurality of first strands form a plurality of loops sleeved to one another, and a height of each of the plurality of loops is smaller than the aperture of each of the plurality of meshes and is smaller than the radial dimension of each of the two head portions; the woven layer is stretchable in an axial direction of the main body, a ratio range of length variations of the woven layer before and after stretch to an unstretched length of the woven layer is between 0.1 and 0.5; the woven layer and the core material are free of interference with each other and movable relative to each other in the axial direction and the radial direction of the main body; at least one of the plurality of first strands and at least one of the plurality of second strands are different in color; and a radial dimension of the hollow portion is larger than the aperture of each of the plurality of meshes.

* * * * *